United States Patent [19]

Magoon et al.

[11] Patent Number: 4,693,165

[45] Date of Patent: Sep. 15, 1987

[54] LIQUID PROPELLANT GUN

[75] Inventors: Inder K. Magoon, Pittsfield; Robert E. Mayer, Williamstown, both of Mass.

[73] Assignee: General Electric Company, Pittsfield, Mass.

[21] Appl. No.: 879,723

[22] Filed: Jun. 27, 1986

[51] Int. Cl.[4] ..... F41F 1/04

[52] U.S. Cl. ..... 89/7; 89/8

[58] Field of Search ..... 89/7, 8, 1.1

[56] References Cited

U.S. PATENT DOCUMENTS

| | | | |
|---|---|---|---|
| 4,231,282 | 11/1980 | Ashley | 89/7 |
| 4,341,147 | 7/1982 | Mayer | 89/7 |
| 4,523,507 | 6/1985 | Magoon | 89/7 |
| 4,523,508 | 6/1985 | Mayer et al. | 89/7 |
| 4,586,422 | 5/1986 | Magoon | 89/7 |

*Primary Examiner*—David H. Brown

*Attorney, Agent, or Firm*—Bailin L. Kuch

[57] ABSTRACT

This invention provides a liquid propellant gun embodying a first species of this invention wherein the inner differential area piston is controlled by a variable damping mechanism, and both pistons have respective cross-sectional areas coupled to the pumping chamber.

2 Claims, 6 Drawing Figures

LIQUID PROPELLANT GUN

BACKGROUND OF THE INVENTION

1. Field of the Invention

This invention relates to guns utilizing liquid propellant and a differential piston to provide regenerative injection of the propellant into the combustion chamber after an initial ignition of propellant in the combustion chamber.

2. Prior Art

An extensive summary of the prior art appears in the patent applications of M. Bulman, Ser. No. 840,074, R. A. Algera, Ser. No. 840,075, and R. E. Mayer, Ser. No. 840,104, all filed Oct. 6, 1977. More recent exemplars of the prior art are the patents of R. E. Mayer, U.S. Pat. No. 4,341,147, issued July 27, 1982; I. K. Magoon, U.S. Pat. No. 4,523,507, issued June 18, 1985; R. E. Mayer et al, U.S. Pat. No. 4,523,508, issued June 18, 1985; and I. K. Magoon, U.S. Pat. No. 4,586,422, issued May 6, 1986.

These more recent exemplars of Mayer and Magoon show a stationary central control rod aft of the combustion chamber which cooperates with an outer annular injection piston to pump liquid propellant from a mutually defined storage chamber, through a mutually defined injection annular orifice, to the combustion chamber.

The exemplar of Mayer, U.S. Pat. No. 4,341,147, shows both a stationary central control rod and a moveable central piston which controls the flow of propellant through a series of holes in the shaft of a T-shaped propellant injection piston as a function of the relative displacement of the inner and outer elements.

The applications of Bulman and Mayer show a stationary gun barrel with an outer annular piston and an annular, piston-like, fill valve, both substantially forward of the combustion chamber. The piston pumps liquid propellant from a storage chamber defined by the piston and the valve into the combustion chamber.

SUMMARY OF THE INVENTION

An object of this invention is to provide a liquid propellant gun wherein the mass rate of flow of liquid propellant can be repetitively, selectively, and continuously varied throughout the interval of time of firing a single shot.

Another object of this invention is to provide a liquid propellant gun wherein the mass rate of flow of liquid propellant can be selectively varied from shot to shot.

The ability to continuously vary the mass rate of flow provides control of the combustion gas pressure in the combustion chamber and the gun barrel aft of the projectile during the interior ballistic period of the gun cycle and thereby provides control over the acceleration and the exit velocity of the projectile. This control permits the use in the same gun of projectiles of respective different weights, of different sensitivities to acceleration, and of different desired trajectories.

A feature of this invention is the provision of a liquid propellant gun wherein (i) the mass rate of flow of the liquid propellant into the combustion chamber is a function of the cross-sectional area of the injection orifice, and (ii) said area is a function of the differential displacement of two differential area pistons, and (iii) the displacement of each of said pistons are a function, inter alia, of the gas pressure in the combustion chamber.

BRIEF DESCRIPTION OF THE DRAWING

These and other objects, advantages and features of the invention will be apparent from the following specification thereof taken in conjunction with the accompanying drawings in which.

DESCRIPTION OF THE INVENTION

Figure 1:
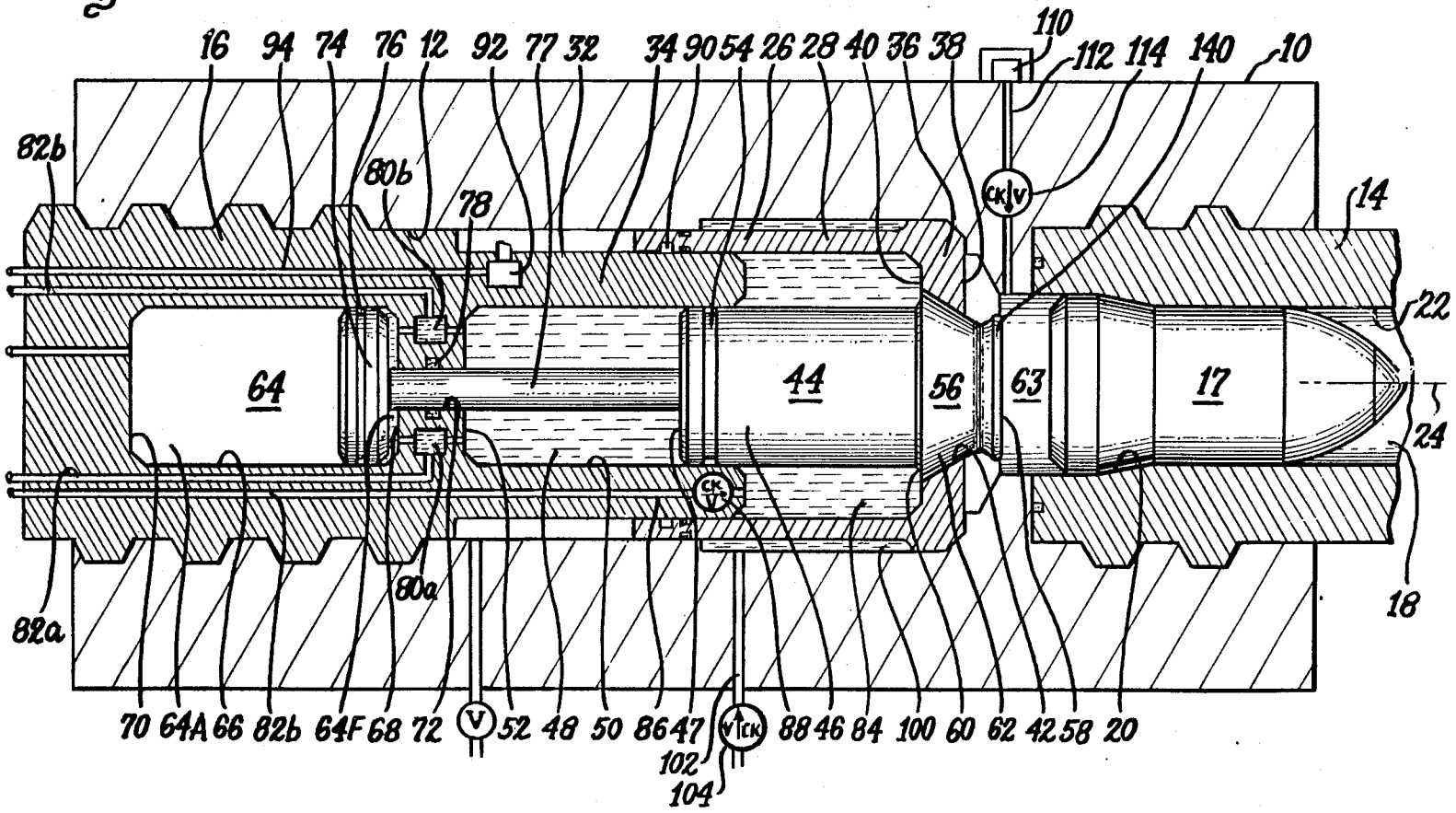
FIG. 1 is a side view in longitudinal section of a liquid propellant gun embodying a first species of this invention wherein the inner differential area piston is controlled by a variable damping mechanism, and both pistons have respective cross-sectional areas coupled to the pumping chamber.

The several species of the invention each have two differential area pistons which jointly pump propellant under the control of a programmed mechanism to provide a programmed injection of propellant into the combustion chamber. Thereby, a large propellant pumping rate may be programmed by a control means applied to a small volume of control fluid. In each species, after initiation of combustion in the combustion chamber, the displacement of one differential area piston, which is herein called the controlled piston, is a function of (i) the gas pressure in the combustion chamber, (ii) the propellant liquid pressure in the pumping chamber, and (iii) the displacement of the other differential area piston, which is herein called the controlling piston. The displacement of the controlling piston is a function of (i) the gas pressure in the combustion chamber, (ii) the liquid pressure in the damping mechanism, and in addition (iii) the liquid pressure in the propellant pumping chamber for species shown in FIGS. 1, 2 and 5. The cross-sectional area of the injection orifice, which orifice is an annulus defined by the relative displacement of the respective heads of the two pistons, is a function of said relative displacement, which is the output function of a servo loop.

The basic principle of operation in achieving controlled injection lies in making the respective ratios of the differential areas of each of the pistons different and providing a programmed resistance to the shaft of the controlling piston. The ratios are chosen such that the ratio of the contolling piston is greater than the ratio of the controlled piston, i.e.:

Eq. 1:

[Combustion chamber face area/Pumping chamber face area] of the controlling piston is greater than

[Combustion chamber face area/Pumping chamber face area] of the controlled piston.

The pumping chamber and the combustion chamber can be considered to be plenum chambers with respective uniform pressures acting on all surfaces in each chamber at a given instant of time.

The operation may be understood by considering a ramp function of combustion gas pressure to be applied within the combustion chamber while the pumping chamber is full of liquid propellant, and while both pistons are at rest with their respective heads in mutual contact, thereby closing the injection orifice.

The ramp function of combustion gas pressure acts on the respective combustion chamber faces of both pistons and causes them each to be accelerated aftwardly compressing the propellant and increasing the liquid propellant pressure. When the propellant pressure in the pumping chamber reaches a value which satisfies equation (2) the net force acting on the controlled piston is zero and its acceleration is zero.

Eq. 2:

[Combustion chamber pressure × combustion chamber face area] of the controlled piston minus [Pumping chamber pressure × pumping chamber face area] of the controlled piston equals zero.

Meanwhile the controlling piston continues to accelerate aftwardly with a net force acting toward the breech since by virtue of the inequality stated by Eq. 1:

Eq. 3:

[Combustion chamber pressure × combustion chamber face area] of the controlling piston minus [Pumping chamber pressure × pumping chamber face area] of the controlling piston is greater than zero.

Consequently, the two pistons tend to move aftwardly at different respective velocities, thereby increasing the gap between their respective heads, i.e. increasing the cross-sectional area of the injection orifice. There is a tendency for the controlling piston to try to pump the liquid pressure in the pumping chamber to a value above that required for force balance of the controlled piston (Eq. 2). But such an over-pressure produces deceleration of the velocity of the controlled piston which further increases the cross-sectional area of the injection orifice, which reduces the hydraulic flow resistance of the liquid in the pumping chamber, which results in an actual instantaneous liquid pressure somewhere between the values determined at force balance by the two different ratios of area of the respective pistons. This system is thus a closed loop hydraulic servo system.

If now a hydraulic resistance is applied to an aft face portion of the controlling piston such that the pressure developed against the aft face of said shaft is a function, for example, of the velocity of the controlling piston, the controlling piston will continue to accelerate until it reaches a velocity which provides sufficient hydraulic resistance (pressure × aft face area) to balance the driving force of the pressure of the combustion gas on the forward face of the controlling piston:

Eq. 4:

[Combustion chamber pressure × combustion chamber face area] of the controlling piston minus [Propellant pumping chamber pressure × propellant pumping chamber face area] of the controlling piston minus [Damping chamber pressure × damping chamber face area] of the controlling piston equals zero.

Then, a steady state operating condition is achieved, assuming constant combustion chamber pressure, in which both pistons are in force balance at zero acceleration and moving aftwardly at the same velocity with the cross-sectional area of the injection orifice determined by the difference in relative positions of the controlled piston and the controlling piston. If one of the parameters considered fixed in the analysis above varies from the assumed condition, the steady state operating condition will shift to accomodate the new parameter for force balance. Under transient conditions, inertial forces must be taken into account to determine the instantaneous acceleration of the pistons, but the result is that the velocity of the controlled piston tends to be "served" to a force balance to follow and to approximate the velocity of the controlling piston as steady state velocity is approached.

In order to select and to provide a desired profile of mass-rate of flow of injected liquid propellant for a selected shot, the hydraulic resistance applied to the shaft of the controlling piston can be programmed as a function of several possible parameters. The hydraulic resistance can be a function of the cross-sectional area of an orifice in the hydraulic control circuit, which area can be a function of the position of the controlling piston, or the temperature or pressure of the liquid propellant in the pumping chamber. If the viscosity of the hydraulic control fluid is not sensitive to temperature, then, notwithstanding that the viscosity of the liquid propellant may be sensitive to temperature, the pressure-time curve of the combustion chamber can be made more insensitive to temperature variations. Those temperature variations may be either as a result of the firing schedule (i.e. burstfiring) or the ambient temperature.

The hydraulic resistance may be increased significantly towards the end of the aftward stroke of the controlling piston, to bring both pistons to a relative soft stop at the end of their respective strokes.

The gun shown in FIG. 1 includes a receiver 10 having a longitudinally extending cavity 12 therein, whose forward end receives a gun barrel 14 and whose aft end receives a breech obturator 16. The barrel and the obturator are each releasably secured to the receiver by conventional means, here shown as threads. The obturator may be advanced into the cavity 12 more or less as desired to vary its internal open volume or it may remain fixed and the initial chamber volume allowed to vary as the charge is varied. A projectile 17 may be inserted into the projectile chamber 18 of the gun barrel 14, which barrel may have a conventional forcing cone 20 and rifling 22. Projectiles may be sequentially fed and chambered by an appropriate loading mechanism which is not shown here; but see, for example, U.S. Pat. No. 4,244,270, issued to D. P. Tassie on Jan. 13, 1981. The gun barrel 14, the cavity 12, and the obturator 16 are shown as mutually coaxial, i.e., "in-line," on the longitudinal axis 24 of the gun.

An outer, differential area, controlled piston 26 has an aft tubular body 28 which rides within an annular cavity defined by the inner wall of the cavity 12 and the outer wall 32 of a reduced diameter forward portion 34 of the obturator 16. The piston 26 has a forward annular head 36 having a forward annular face 38 of relatively large cross-sectional area, an aft annular face 40 of relatively small cross-sectional area and a conical opening 42.

An inner, differential area, controlling piston 44 has an aft cylindrical body 46 which rides within a cylindrical cavity 48 having a side wall 50 and a base wall 52 in the obturator 16. The body 46 has an aft face 47 and carries an annular seal 54 which seals against the side wall 50 to close, with aft face 47, the cavity 48. The piston 44 has a forward frusto-conical head 56 having a forward circular face 58 of relatively large cross-sectional area, an aft annular face 60 of relatively small cross-sectional area, and a conical side wall 62 which mates with the conical opening 42. The combustion chamber 63 is defined by the aft face of the projectile 17, the piston forward faces 58 and 38, and the inner wall of the cavity 12.

The obturator 16 also includes an internal cylindrical cavity 64 having a sidewall 66, a forward wall 68 and a base wall 70. A longitudinal bore 72 extends between the faces 52 and 68. A piston 74 is disposed within the cavity 64 and has an annular seal 76 which seals against the side wall 66 to divide the cavity 64 into a forward portion 64F and an aft portion 64A. A rod 77 is fixed to and between the controlling piston 44 and the piston 74 and passes through the bore 72. A seal 78 is fixed in the bore 72 and seals against the rod 77.

A control valve mechanism, here shown as two valves 80*a* and 80*b*, is also respectively connected to and between the faces 52 and 68 to permit the flow of hydraulic fluid between the cavity 48 and the cavity 64F. The orifice area in each control valve may be variably controlled through a respective control passageway 82*a* and 82*b* so as to variably limit the mass rate of flow of hydraulic fluid between the cavities 48 and 64F. The control valve may be pressure controlled, spring return, where the pressure in the control passageway is controlled by a cam operated spool valve assembly as shown in U.S. Pat. No. 3,763,739 issued to D. P. Tassie on Oct. 9, 1973.

The cavity 84, defined by the two pistons 26, 44 and the obturator 16, serves as the liquid propellant reservoir or propellant pumping chamber; and is filled through a passageway 86 having a checkvalve 88, both in the obturator 16. The volume of this reservoir 84 is determined by length that the obturator 16 has been set into the cavity 12 of the receiver 10. Alternatively, a lesser volume can be determined by limiting the joint forward travel of the two pistons to less than full forward.

A latch mechanism to hold the outer piston 26, and with it, the inner piston 44, fully seated in its aft disposition on the forward portion 34 of the obturator 16, may include an annular notch 90 in the outer piston 26 and a pressure controlled, spring return detent 92 having a control passageway 94, whose pressure may be controlled by a cam operated spool valve assembly.

An annular cavity 100 may be provided around the outer piston 26 which may be prefilled with hydraulic fluid via a passageway 102 with a check valve 104 to provide hydraulic support to the annular wall of the piston during firing. This cavity may also receive additives, if desired, to be passed into the combustion chamber 63 during the aftward stroke of the outer piston 26. Alternatively, the cavity 100 may be omitted.

A source 110 of initial combustion gas is coupled by a passageway 112, which may have a check valve 114, into the combustion chamber 63 to provide an initial supply of gas under pressure in the combustion chamber to initiate the aftward stroke of the controlling piston 44, to apply pressure to the liquid propellant in the pumping chamber 84 and thereafter to open the injection orifice defined by the conical surfaces 42 and 62. This source may be an electrically fired primer, which is replaced as each projectile is chambered; or it may be an electrically fired liquid propellant initiator, or it may be an adiabatic igniter as shown in U.S. Pat. No. 4,231,282 issued to E. Ashley on Nov. 4, 1980.

Figure 5:
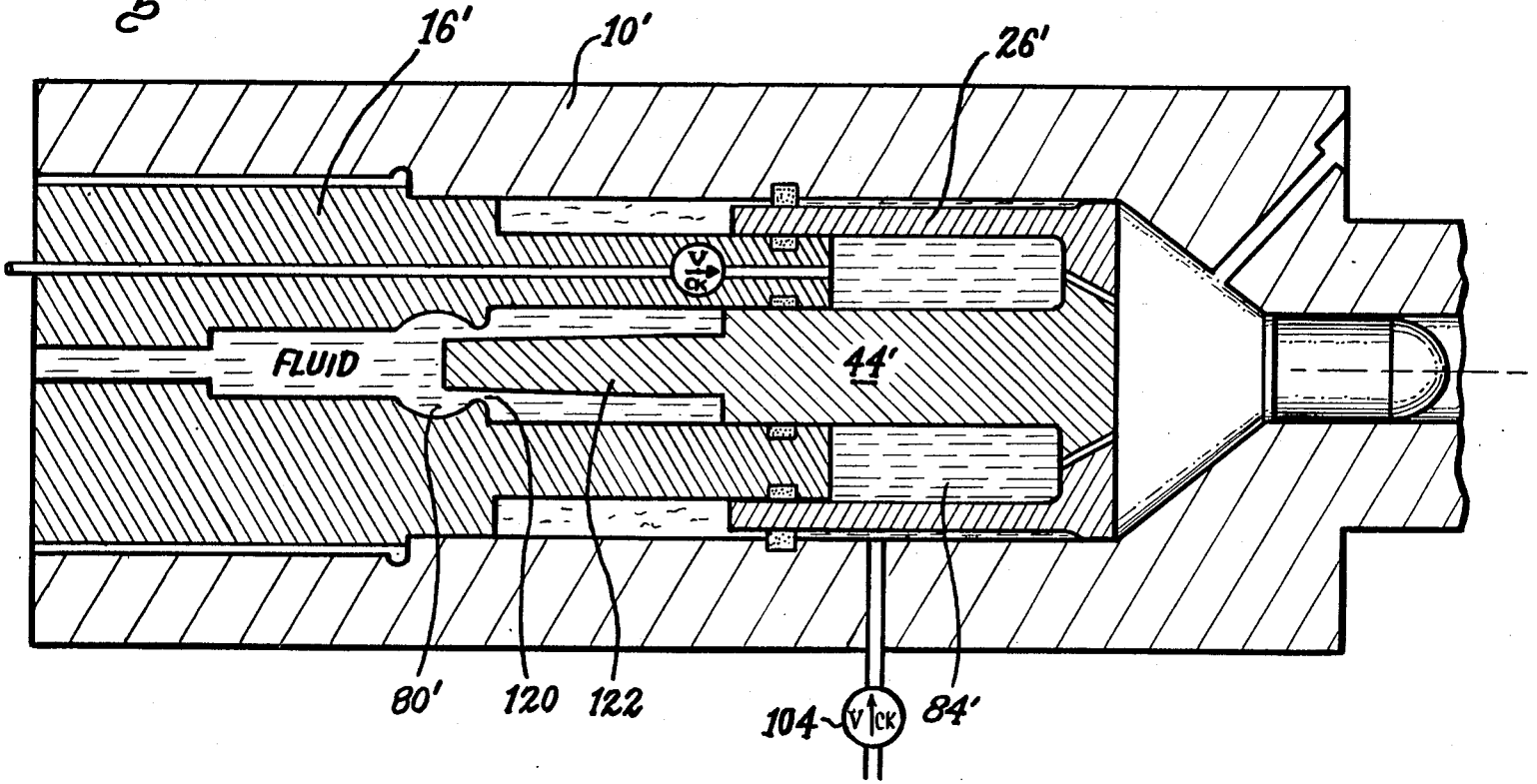
FIG. 5 is a simplified version of the species of FIG. 1.

A simplified version of the hydraulic damping control of FIG. 1 is shown in FIG. 5. Here the damping, variable area, orifice 80', equivalent to 80*a* or 80*b*, is defined by an annular opening 120 formed in the breech obturator 16' and a contoured stem 122 which extends aftwardly from the controlling piston 44'. The diameter of the stem adjacent the opening 120 determines the area of the orifice. As here shown, the orifice area will be minimized towards the end of the aftward stroke of the controlling piston 44' to bring both it and the controlled piston 26' to a soft stop into rear dwell.

FIG. 1 shows one mechanism for refilling liquid propellant into the pumping chamber. When the controlled piston 26 reaches the end of its aft stroke its notch 90 is captured by the latch 92 to hold that piston 26, and thereby the controlling piston 44, in aft dwell. When liquid propellant is admitted through the passageway 86 the latch 92 is released, or overcome by propellant loading pressure, to move both pistons together, with the injection orifice closed, forwardly to the end of their forward stroke. Captured gas under pressure in the cavity 64A may be utilized to insure that the controlling piston 44 moves with the controlled piston 26 to keep the injection orifice closed.

Alternatively, it may be desired to permit an initial leak of a controlled volume of liquid propellant at the start of the forward stroke, so that subsequently such liquid propellant then in the combustion chamber, may be ignited by an electric spark or laser to provide combustion gas to start the firing cycle.

FIG. 1 also shows a rib 140 extending radially from the forward face 58 of the controlling piston 44. This rib is maintained in a substantially fixed position relative to the injection orifice throughout the firing stroke and serves to disperse or break up the flowing sheet of the propellant throughout the combustion chamber.

In many usages, as for example in an artillery weapon, it is necessary not only to vary the propellant injection rate, and thereby the combustion gas generation rate, but also to vary the total propellant charge. As shown in FIG. 1, the obturator 16 may be advanced more or less into the receiver 10 to decrease or to increase the volume of the pumping chamber 84 and thereby the volume of propellant admitted into the pumping chamber.

Figure 2:
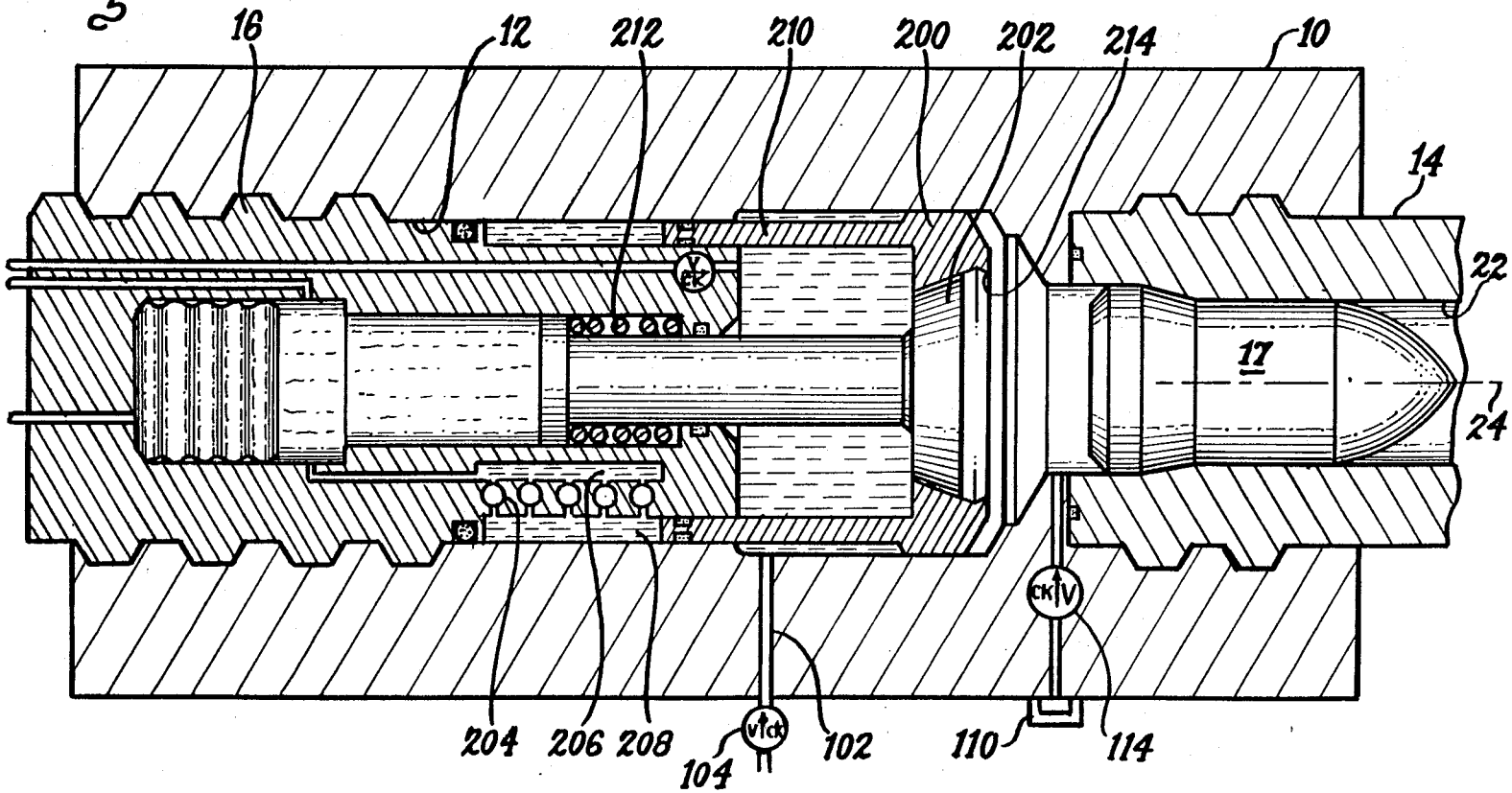
FIG. 2 is similar to FIG. 1 but embodying a second species wherein the outer differential area piston is controlled by a variable damping mechanism, and both pistons have respective cross-sectional areas coupled to the pumping chamber.

FIG. 2 shows the outer differential area piston 200 serving as the controlling piston, and the inner differential area piston 202 serving as the controlled piston. In this species the motion of the controlling piston 200 is controlled by a variable hydraulic control circuit 204 coupling annular cavities 206 and 208. The annular stem 210 of the piston 200 travels within the cavity 208 during the aft stroke of the piston and must displace the hydraulic fluid from the cavity 208 through the control circuit 204. A helical compression spring 212 is disposed on the stem of the piston 202 to hold this piston 202 against the piston 200 during the propellant loading process to maintain the injection orifice closed. A deflector such as rib 214 extending radially from the combustion chamber face of the controlling piston 200 may be used to serve as a break up device for the sheet of liquid propellane injected through the injection orifice.

Figure 3:
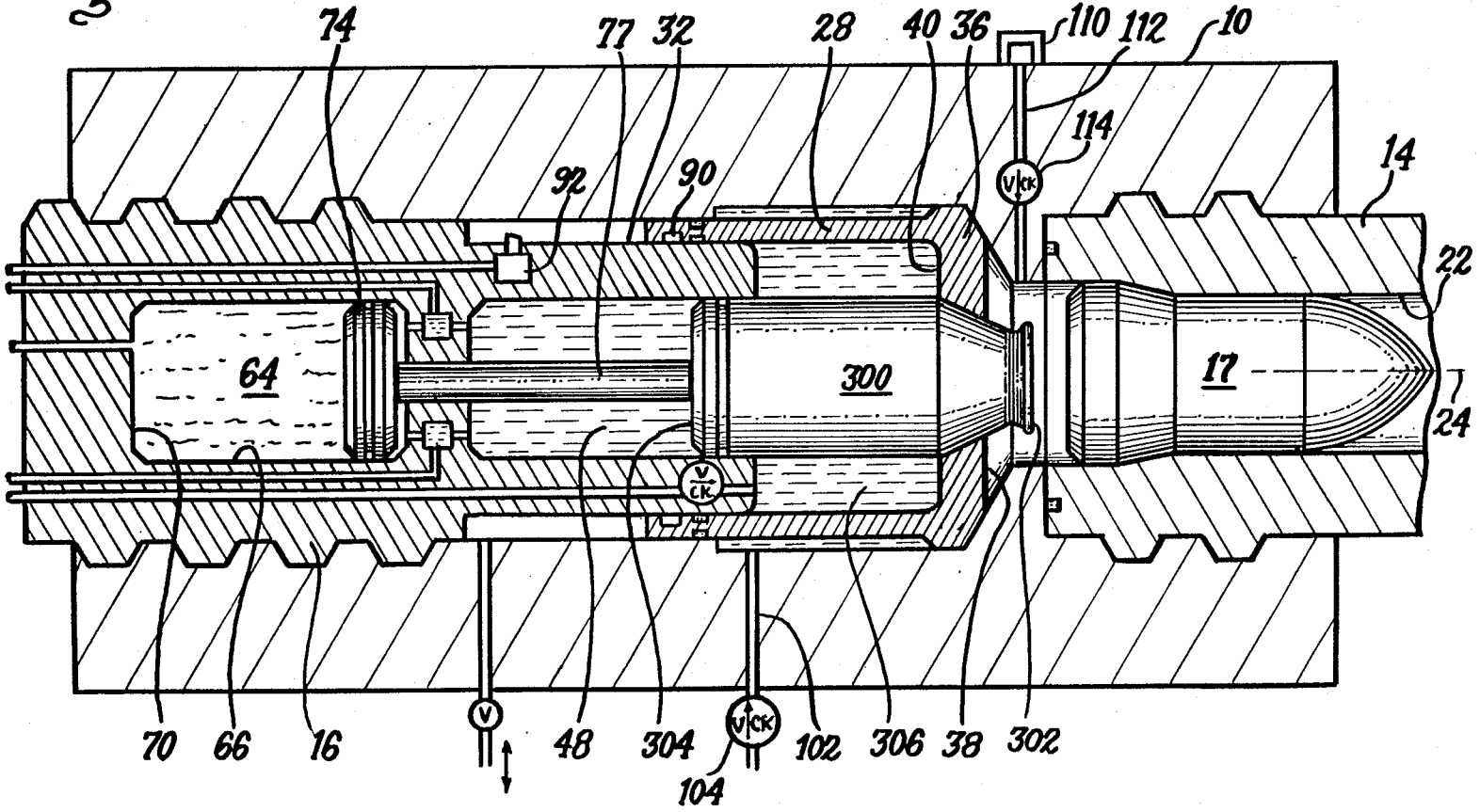
FIG. 3 is similar to FIG. 1 but embodying a third species wherein the inner differential area piston is controlled by a variable damping mechanism and has no cross-sectional area coupled to the propellant pumping chamber.

FIG. 3 shows a species which is similar to that of FIG. 1, except that the controlling inner piston 300 has a combustion chamber circular face 302 and a damping chamber annular face 304, but not any face on the pumping chamber 306. Thus, the second term of equation 4 is zero with respect to this species.

Figure 4:
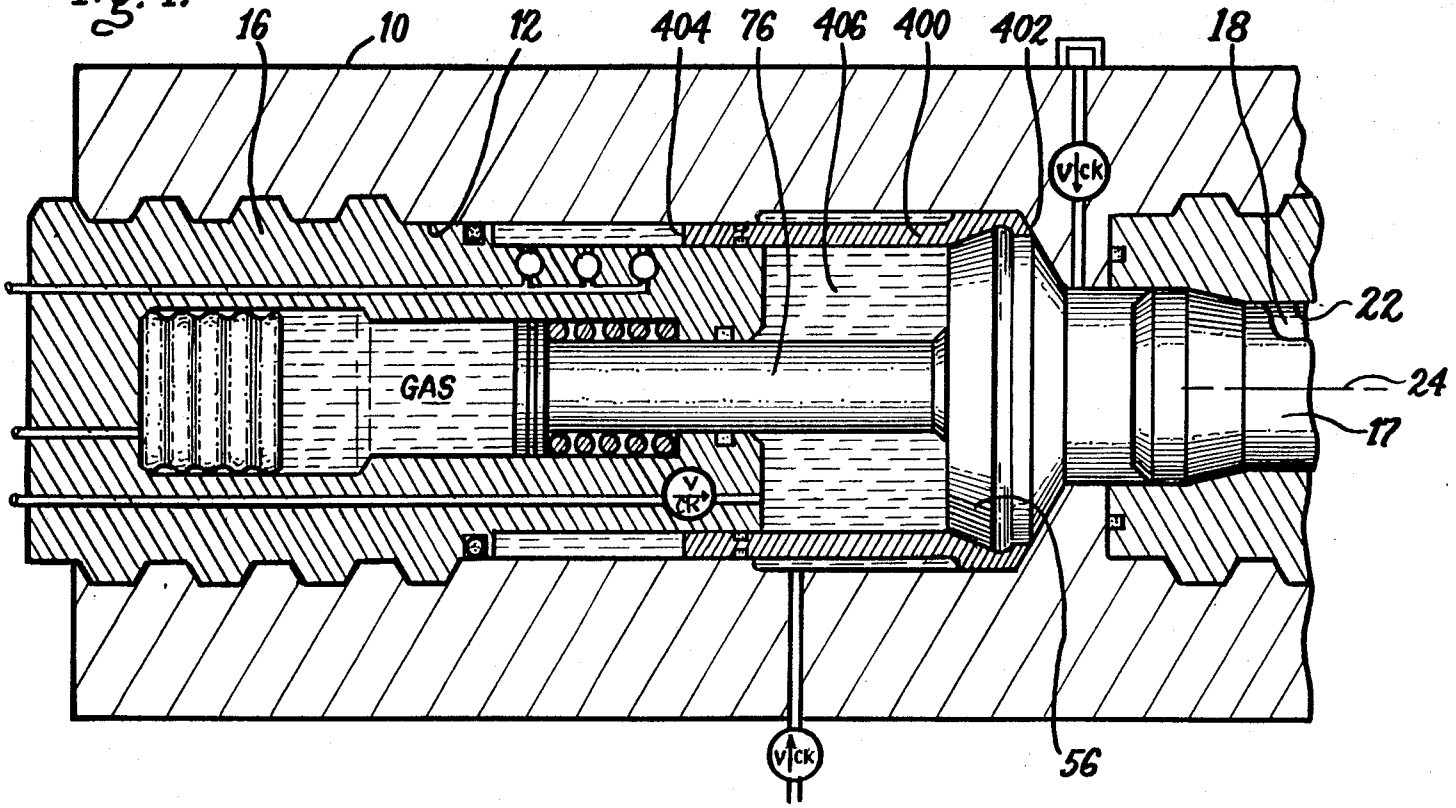
FIG. 4 is similar to FIG. 1 but embodying a fourth species wherein the outer differential area piston is controlled by a variable damping mechanism and has no cross-sectional area coupled to the propellant pumping chamber.

FIG. 4 shows a species which is similar to that of FIG. 2 except that the controlling outer piston 400 has a combustion chamber annular face 402 and a damping chamber annular face 404, but not any face on the pumping chamber 406. Thus, the second term of equation 4 is zero with respect to this species.

Thus in the species of FIGS. 3 and 4, the motion of the controlling piston is independent of the pressure fluctuations in the liquid propellant in the propellant pumping chamber.

Figure 6:
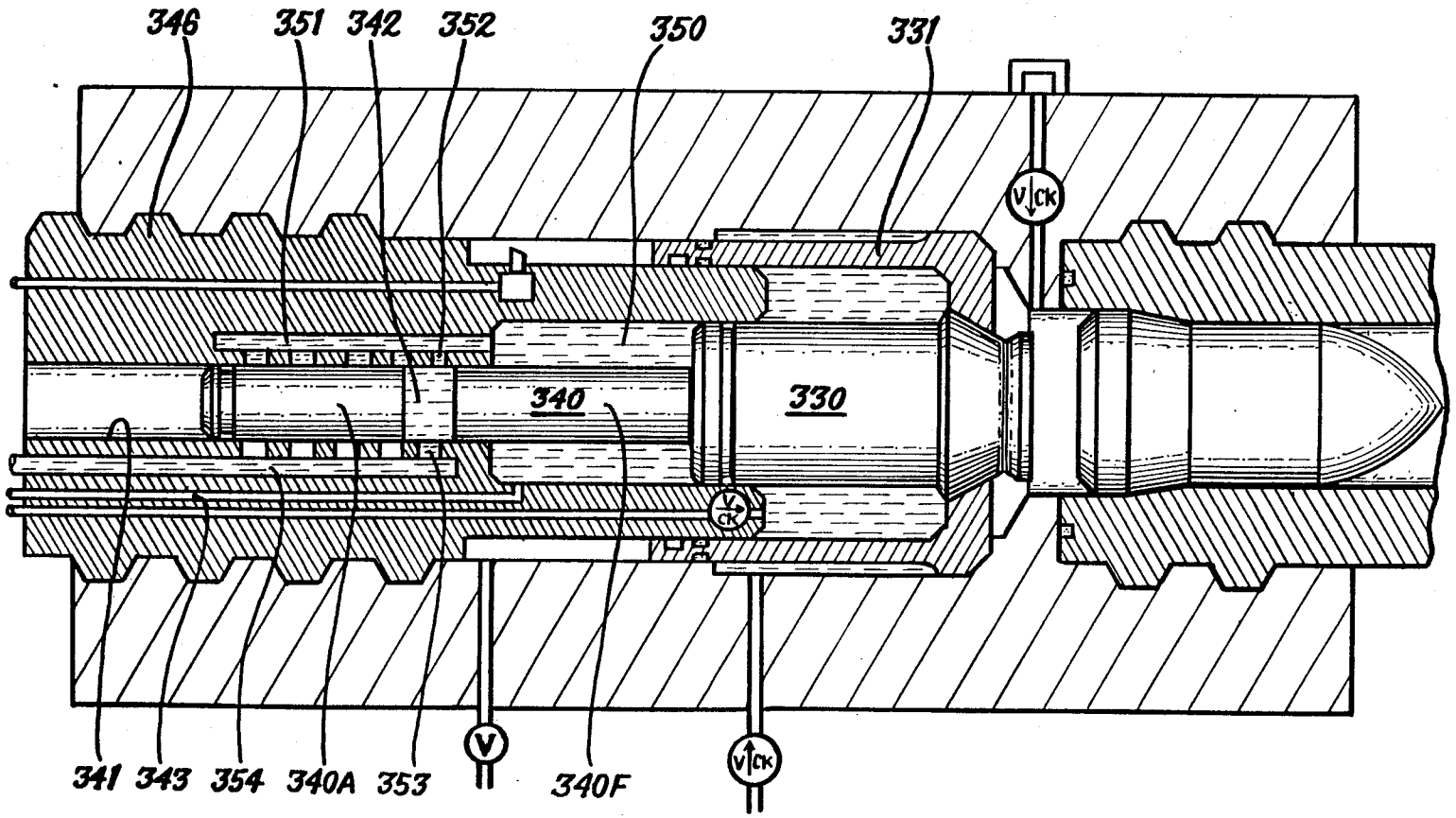
FIG. 6 is another simplified version of the species of FIG. 1.

FIG. 6 shows another version of the hydraulic damping control of FIG. 1. Here the variable area damping orifice 352, equivalent to 80*a*, and 80*b*, is defined by a series of orifices connected to a series of orifices 353 by a slot 342 located by front 340F and aftward 340A portions of cylindrical stem 340 which extends aftwardly from the controlling piston 330. The cylindrical stem 340 slides into a cylindrical bore 341 provided in the breech obturator 346. As the stem 340 slides into the cylindrical bore 341, the slot 342 also moves and connects the variable area damper orifices 352 to the variable area orifices 353. The variable area orifices 352 are connected to cavity 350 by the passageway 351 and the variable area orifices 353 are connected by the passageway 354. Here as shown, the damper orifice area will be minimized towards the end of the aftward stroke of the controlling piston 330 to bring both it and the controlled piston 331 to a soft stop into rear dwell. The damper orifice area can be varied by opening or closing the orifices 352. A passageway 343 is provided to fill hydraulic fluid into the damper cavity 350.

What is claimed is:

1. A process of controlling the mass rate of flow in an annular sheet of liquid propellant from a liquid propellant storage chamber to a combustion chamber, wherein the sheet flows through an annular orifice which is defined by the relative movement of two coaxial piston heads, comprising:

providing gas pressure from the combustion chamber to a forward face of each of the two piston heads to provide an aftwardly directed respective force on each of said piston heads;

controlling the aftward movement of one of said piston heads in response to the respective force on its forward face;

whereby the relative aftward movement of the other of said piston heads determines the cross-sectional area of said annular orifice as a function of the forwardly directed force of liquid propellant on the aft face of said other piston head and said aftwardly directed force from said combustion chamber on said forward face.

2. A process according to claim 1 further including:

providing said one of said piston heads with a first means for multiplying combustion gas pressure into a pumping pressure on the liquid propellant in the liquid propellant storage chamber, providing said other of said piston heads with a second means for multiplying combustion gas pressure into a pumping pressure on the liquid propellant in the liquid propellant storage chamber, said second means having a greater multiplication ratio than said first means.

* * * * *